US012102136B2

(12) United States Patent
Rush et al.

(10) Patent No.: US 12,102,136 B2
(45) Date of Patent: Oct. 1, 2024

(54) UNIVERSAL FILTERING MOUTHPIECE FOR SMOKING DEVICES

(71) Applicants: Daniel Rush, Los Angeles, CA (US); Jason Rush, Inglewood, CA (US); Maria Testa, Los Angeles, CA (US)

(72) Inventors: Daniel Rush, Los Angeles, CA (US); Jason Rush, Inglewood, CA (US); Maria Testa, Los Angeles, CA (US)

( * ) Notice: Subject to any disclaimer, the term of this patent is extended or adjusted under 35 U.S.C. 154(b) by 815 days.

(21) Appl. No.: 16/923,436

(22) Filed: Jul. 8, 2020

(65) Prior Publication Data

US 2022/0007713 A1 Jan. 13, 2022

(51) Int. Cl.

| | |
|---|---|
| ***A24F 7/04*** | (2006.01) |
| ***A24D 3/04*** | (2006.01) |
| ***A24D 3/06*** | (2006.01) |
| ***A24D 3/16*** | (2006.01) |
| ***A24D 3/18*** | (2006.01) |

(52) U.S. Cl.
CPC ..... *A24F 7/04* (2013.01); *A24D 3/04* (2013.01); *A24D 3/068* (2013.01); *A24D 3/163* (2013.01); *A24D 3/18* (2013.01)

(58) Field of Classification Search
CPC ..... A24F 13/06; A24F 7/04
See application file for complete search history.

(56) References Cited

U.S. PATENT DOCUMENTS

| | | | | |
|---|---|---|---|---|
| 3,043,314 | A * | 7/1962 | Bartolomeo | A24D 3/043 131/331 |
| 3,805,808 | A * | 4/1974 | Yoshinaga | A24F 13/10 131/182 |
| 10,251,421 | B2 * | 4/2019 | Kieslich | A24F 42/10 |
| 2007/0186940 | A1 * | 8/2007 | Bhattacharyya | A24D 3/08 131/342 |
| 2020/0281263 | A1 * | 9/2020 | Barenboym | A24F 13/02 |

OTHER PUBLICATIONS

AllGlass.com, The MouthPeace by Moose Labs AllGlass.com's Hands-On First Look, 10 pages (Year: 2015).*

* cited by examiner

*Primary Examiner* — Michael J Felton
(74) *Attorney, Agent, or Firm* — The Thornton Firm, LLC

(57) ABSTRACT

A universal filtering mouthpiece for smoking devices comprising a flexible and substantially conical shaped body having a small diameter end and a large diameter end; a hollow smoke passage which runs axially through the conical shaped body from the small diameter end to the large diameter end; a filter cartridge housing centered axially at the mouthpiece end of the said flexible and substantially conical shaped body which communicates with the hollow smoke passage and capable of housing a removable filter; and a disposable, high-airflow filter cartridge consisting of a rigid cylindrical frame having rounded edges, the rigid cylindrical frame housing a smoke filter inside the inner diameter of said rigid cylindrical frame. The universal filtering mouthpiece for smoking devices is readily implementable across a wide variety of smoking devices such as, but not limited to, pipes, bongs, hookahs, water pipes, electronic cigarettes, cigarettes, and pre-roll cigarettes.

15 Claims, 8 Drawing Sheets

UNIVERSAL FILTERING MOUTHPIECE FOR SMOKING DEVICES

CROSS-REFERENCE TO RELATED APPLICATIONS

Not applicable.

RELATED CO-PENDING U.S. PATENT APPLICATIONS

Not applicable.

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

BACKGROUND OF THE INVENTION

1. Field of the Invention

The invention relates generally to smoking devices. More specifically, the invention relates to a universal filtering mouthpiece for smoking devices.

2. Description of the Related Art

Hundreds of millions of people enjoy smoking. Smoking tobacco and other substances has been, and still is, a popular recreational activity in the United States and abroad. Smoking is enjoyed in both individual and social settings. Given population increases and the recent trend of legalizing *cannabis* for medical or recreational use in the United States, Canada, Europe, and other countries means more people are smoking than ever before.

The smoking of tobacco, tobacco-like substances, *cannabis* and the concentrates derived therefrom has proven to be harmful to users due to numerous combustion byproducts and particulates such as, but not limited to, tars, ashes, volatile organic compounds and carbon monoxide. Filters made of various materials were created and have been used to reduce the particulate content in smoke phase through filtration and adsorption. In numerous laboratory tests over several decades, the use filters has been shown to reduce tars and other volatile organic compounds in inhaled smoke.

Social consumption of tobacco, tobacco-like substances, *cannabis* and the concentrates derived therefrom has also led to excessive and unnecessary microbial contamination and transfer. Consumption of *cannabis*, for example, has traditionally been a social activity where people not only smoke and consume together, but pass a cigarette, pipe or other smoking device from person to person, thereby leading to increased risk of infection by a wide variety of pathogens.

Most people take preventative measures to avoid intentional contamination when using shared devices. For example, people usually wash their hands before handling cookware or eating utensils. Smokers, namely *cannabis* users, though, seem to disregard common sense health and safety practices when it comes to smoking *cannabis* both in shared settings and privately at home. Many viruses and bacteria can be transmitted simply by sharing pipes amongst friends and roommates, not to mention being at a public event sharing with hundreds or thousands of people from different states and countries. Numerous bacteria are known to be able to survive on surfaces for days. Many viruses, such as influenzaviridae and coronaviradae, can survive on surfaces such as smoking devices for well over eight hours.

With virtually every corner of the world currently being affected by the recent coronavirus pandemic, there exists a need for a universal filtering mouthpiece for smoking devices which can lessen the risk of infection by pathogens and mitigate the spread thereof. Such a mouthpiece and method of use must be able to prevent the transmission of, and infection from, infectious pathogens, filter impurities out of smoke, provide a high-airflow filtering device capable of providing a smoker an enjoyable smoking experience, and to provide a universal fitting device for multiple smoking devices.

SUMMARY

The present invention fulfils the need for an improved universal filtering mouthpiece for smoking devices.

An object of the invention is to prevent the transmission of, and infection from, infectious pathogens through the use of individualized universal mouthpieces for smoking devices. In many instances, smokers find themselves sharing smoking devices. The use of the universal filtering mouthpiece for smoking devices has been shown to dramatically decrease the spread of bacteria on shared smoking devices.

Another object of the invention is to filter impurities out of smoke. In numerous smoking devices, simple filtration of impurities is simply not enough to remove large particulate and noncombusted matter from smoke. In certain types of smokable materials, such as *cannabis*, users tend to inhale smoke deeper than users of other smokable materials such as tobacco. This deeper inhalation poses greater risks to smokers. Moreover, smoke is known to contain numerous volatile organic compounds which may also pose a health risk to smokers.

A further object of the invention is to provide a high-airflow filtering device capable of providing a smoker an enjoyable smoking experience. The use of more restrictive filtration devices diminishes airflow capacity, making it difficult for a smoker to draw smoke through a smoking apparatus.

A final object of the invention is to provide a user a universal filtering mouthpiece for smoking devices. Many smokers find themselves in situations where a smoking device is being shared among multiple users; and that an individual portable and universally adaptable mouthpiece could be easily used to both prevent the spread of harmful pathogens among users and to provide a quality filtering apparatus. The universal filtering mouthpiece for smoking devices is designed to be used on a multitude of smoking devices ranging from pipes, bongs, hookahs, water pipes, electronic cigarettes, cigarettes, and pre-roll cigarettes.

The invention is directed to a universal mouthpiece for smoking devices comprising a flexible and substantially conical shaped body having a small diameter end and a large diameter end; a hollow smoke passage which runs axially through the said conical shaped body from the small diameter end to the large diameter end; a filter cartridge housing centered axially at the large diameter end of the said flexible and substantially conical shaped body which communicates with the hollow smoke passage and is capable of housing a removable filter; and a disposable, high-airflow filter cartridge consisting of a rigid cylindrical frame having rounded edges, said rigid cylindrical frame housing a smoke filter inside the inner diameter of said rigid cylindrical frame.

The universal mouthpiece for smoking devices may be sold as individual components. The universal mouthpiece for smoking devices may also be sold as a kit comprising a flexible and substantially conical shaped body having a small diameter end and a large diameter end, said flexible and substantially conical shaped body having a hollow smoke passage which runs axially from the small diameter end to the large diameter end and a filter housing centered axially at the large diameter end which communicates with the hollow smoke passage and capable of housing a disposable removable filter; a disposable, high-airflow filter cartridge package containing one or more disposable high-airflow filter cartridges, each disposable, high-airflow filter cartridge consisting of a rigid cylindrical frame, said rigid cylindrical frame housing a smoke filter inside the inner diameter of said rigid cylindrical frame; and a lanyard.

Use of the universal filtering mouthpiece for smoking devices involves each user cleaning and sanitizing a personal universal mouthpiece for smoking devices; each user inserting a disposable, high-airflow filter cartridge into the filter housing of each individual universal mouthpiece for smoking devices; each user attaching the small diameter end of the universal mouthpiece for smoking devices to a smoking device so as to create an airtight seal; each user smoking from the one or more smoking devices; and each user removing their universal mouthpiece for smoking devices from the smoking device.

The universal filtering mouthpiece for smoking devices is readily implementable across a wide variety of smoking devices such as, but not limited to, pipes, bongs, hookahs, water pipes, electronic cigarettes, cigarettes, and pre-roll cigarettes. The outer diameter of the flexible and substantially conical shaped body is configured to fit into mouthpieces of smoking devices having relatively large inner diameters so as to form an air-tight seal. The inner diameter of the small diameter end of the flexible and substantially conical shaped body is capable of stretching over the ends of smoking devices with relatively narrower outer diameters so as to form an air-tight seal.

The universal filtering mouthpiece is designed to be portable. A user may transport the mouthpiece in a pocket, a purse or other container. A user may also attach a lanyard to a lanyard connection located on the large diameter end of the flexible and substantially conical shaped body. Used with a lanyard, a user may then wear the universal filtering mouthpiece around his or her neck as ornamentation. The universal filtering mouthpiece may assume numerous colors and color combinations from which a user may choose. As such, the universal filtering mouthpiece serves as a great conversation starter in social settings. The universal mouthpiece for smoking devices may also be used and or sold in social businesses such as hookah lounges or other public places where shared smoking devices may be used.

BRIEF DESCRIPTION OF THE DRAWINGS

The invention directed by way of example, and not by way of limitation, in the figures of the accompanying drawings and in which like reference numerals refer to similar elements and in which.

Figure 1:
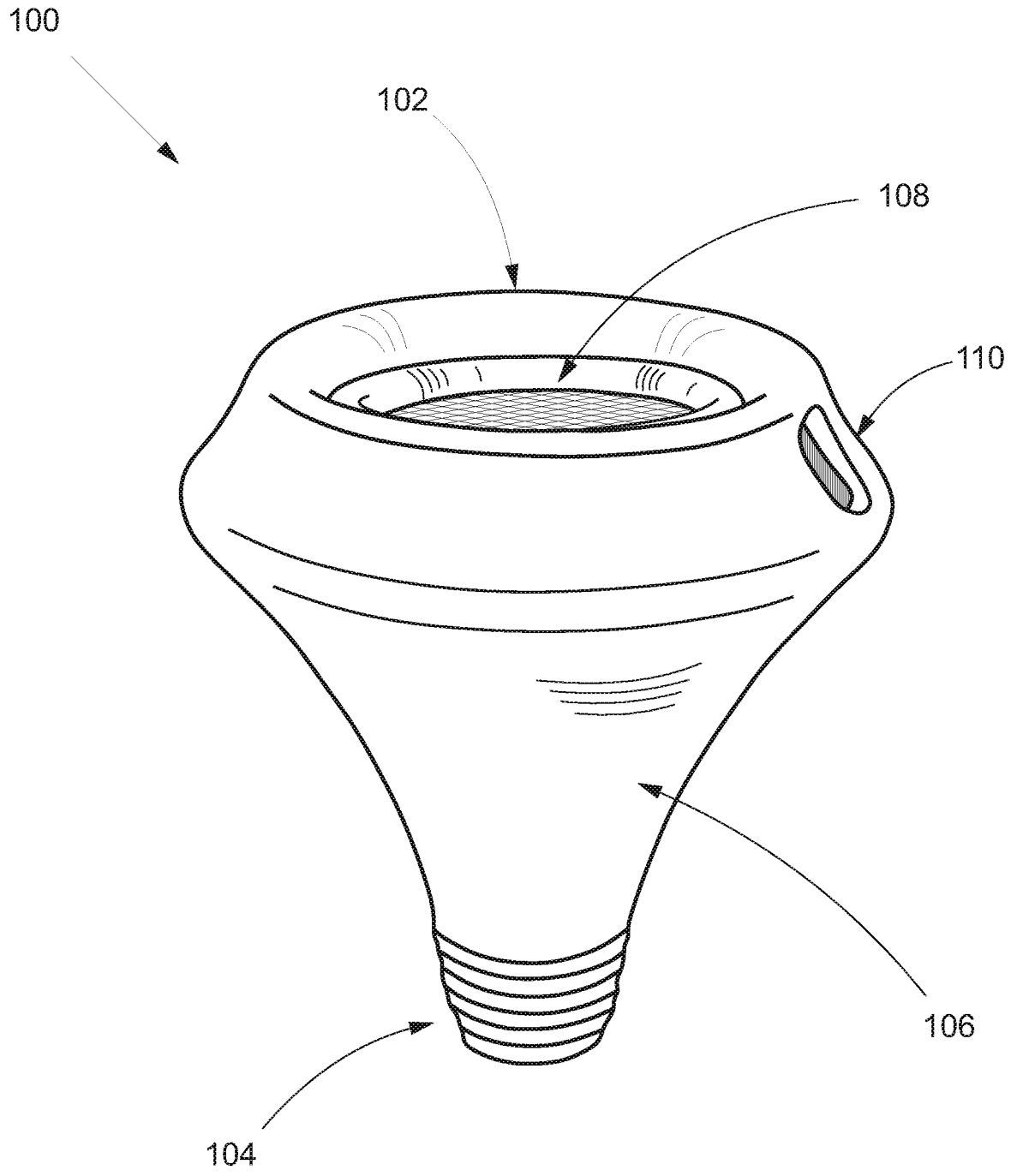
FIG. 1 is a perspective view of a universal filtering mouthpiece for smoking devices in accordance with an embodiment of the invention.

Unless otherwise indicated illustrations in the figures are not necessarily drawn to scale.

DETAILED DESCRIPTION OF THE PREFERRED EMBODIMENTS

Terminology used herein is used for the purpose of describing particular embodiments only, and is not intended to limit the scope of the present invention. It must be understood that as used herein and in the appended claims, the singular forms "a," "an," and "the" include the plural reference unless the context clearly dictates otherwise. For example, a reference to "an element" is a reference to one or more elements and includes all equivalents known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Language that may be construed to express approximation should be so understood unless the context clearly dictates otherwise.

Unless defined otherwise, all technical and scientific terms used herein have the same meanings as commonly understood by a person of ordinary skill in the art to which this invention belongs. Preferred methods, techniques, devices, and materials are described. But any methods, techniques, devices, or materials similar or equivalent to those described herein may be used in the practice or testing of the present invention. Structures described herein should also be understood to refer to functional equivalents of such structures.

A "hookah" is a type of water filtration device that has been in use in the Middle East for centuries. Hookahs are used to smoke organic materials such as tobacco, *cannabis*, and the concentrates derived therefrom. A typical hookah consists of a bowl, a windscreen, a stem, a purge valve, a water base or vase, and one or more hoses. A hookah operates by a user filling a bowl full of tobacco, *cannabis, cannabis* concentrates, or other smokable organic matter. The bowl is connected to a stem which extends from the bowl and enters the water base or vase. The user holds a hose with a mouthpiece that constitutes the end of the system. The user places the mouthpiece to his or her mouth and draws on the mouthpiece creating a pressure differential that pulls smoke through the entire system. The tobacco is packed into a bowl at the top of the system and topped with a screen. The bowl is formed with holes in the bottom, through which smoke from the burning tobacco flows. The smoke passes through the hookah's stem, into the base, and bubbles through the water in the bottom of the water base or vase, out a port in the water base or vase, through a hose and ultimately into the smoker's mouth and lungs.

A "bong" is another type of water filtration device generally used for smoking *cannabis*, tobacco, or other herbal substances. Bongs have been in use in far eastern countries for centuries. In construction and function, a bong is similar to a hookah, only smaller and more portable. A bong is typically constructed from a cylindrical vessel by adding a bowl and stem apparatus through the side of the cylinder, which guides air downward to below water level where it then bubbles upward during use. To get fresh air into the bong and clear the last remaining smoke, a purge valve is located somewhere on the lower part of the bong above water level, is first kept covered during the smoking process, then opened to allow the smoke to be drawn into the respiratory system. Bongs may be constructed in such a manner where the bowl and/or the stem can be removed to create a purge valve that allows air from the hole that holds the stem.

A "pre-roll" is a type of rolled cigarette containing tobacco, tobacco-like substances or *cannabis*. Typical pre-roll cigarettes consist of a filter end and a cigarette end. The filter end may be referred to as a crutch, which is a paper tip that is inserted to prevent the rolled cigarette from collapsing and limiting air flow. A user may purchase individual pre-rolled cigarettes, or a user may purchase pre-roll cartridge-like papers and filters wherein the user fills the cartridge-like papers with tobacco or a tobacco-like substance. The filter end of a pre roll may be used to house numerous filtering substances in order to remove harmful and irritable components of smoke. A user applies a flame or heated element to the cigarette end so as to create smoke which is inhaled through the filter and into the user's lungs.

"Activated carbon," also called "activated charcoal," is a form of carbon processed to have small, low-volume pores that increase the surface area available for adsorption or chemical reactions. Due to its high degree of microporosity, as little as one gram of activated carbon can possess a surface area in excess of over one thousand square meters. Activated carbon is highly effective in removing pollutants from air or water such as volatile organic compounds, tars and other contaminants.

"Sandwich activated carbon cloth" or "activated carbon cloth" or "activated carbon filter cotton" is a three-layer cloth which the top and bottom layers are non-woven fabric cloth, typically made from a synthetic fiber, and the middle layer consists of activated carbon powders. The non-woven fabric cloth and activated carbon powders are typically fastened by high temperature thermal pressing. When used as a filter, activated carbon cloth may provide for a high degree of air flow while being able to filter out a significant amount of large particulate and volatile organic matter.

References to "one embodiment," "one variant," "an embodiment," "a variant," "various embodiments," "numerous variants," etc., may indicate that the embodiment(s) of the invention so described may include particular features, structures, or characteristics. However, not every embodiment or variant necessarily includes the particular features, structures, or characteristics. Further, repeated use of the phrase "in one embodiment," or "in an exemplary embodiment," or "a variant," or "another variant," do not necessarily refer to the same embodiment although they may. A description of an embodiment with several components in communication with each other does not imply that all such components are required. On the contrary, a variety of optional components are described to illustrate the wide variety of possible embodiments and/or variants of the present invention.

As is well known to those skilled in the art, many careful considerations and compromises typically must be made when designing the optimal manufacture or commercial implementation of such a universal filtering mouthpiece for smoking devices. A commercial implementation in accordance with the spirit and teachings of the invention may be configured according to the needs of the particular application, whereby any aspect(s), feature(s), function(s), result(s), component(s), approach(es), or step(s) of the teachings related to any described embodiment of the present invention may be suitably omitted, included, adapted, mixed and matched, or improved and/or optimized by those skilled in the art.

The exemplary universal filtering mouthpiece for smoking devices will now be described in detail with reference to embodiments thereof as illustrated in the accompanying drawings.

FIG. 1 is a perspective view of a universal filtering mouthpiece for smoking devices in accordance with an embodiment of the invention. The universal filtering mouthpiece for smoking devices comprises a flexible and substantially conical shaped body 106 having a large diameter end 102 and a small diameter end 104. In the preferred embodiment of the invention, the conical shaped body of universal filtering mouthpiece for smoking devices is a single unit. The single unit may be made from a relatively soft and flexible material such as, but not limited to, cured silicone. A hollow smoke passage runs axially through the center of conical shaped body 106 from the small diameter end to the large diameter end 102. The large diameter end 102 may taper in differing configurations and in differing directions from the substantially conical shaped body 106 so as to provide a user the opportunity to create a mouthpiece with a better seal around the large diameter end when using the universal filtering mouthpiece for smoking devices. Alternative embodiments of the invention may include differing shapes of both the large diameter end 102 and small diameter end 104. Non limiting examples of differing shapes may include polygons and polyhedrons. The substantially conical shape of the body allows the universal filtering mouthpiece to adapt and conform to a wide variety of smoking devices. The soft material makes the substantially conical shaped body adaptable for numerous applications.

A filter cartridge housing is centered axially at the large diameter end of the said flexible and substantially conical shaped body which communicates with the hollow smoke passage and capable of housing a removable filter. The universal filtering mouthpiece for smoking device includes a disposable, high-airflow filter cartridge 108 which fits snugly in the filter cartridge housing so as to create an air-tight seal. In this view, the filter cartridge 108 is shown for convenience. However, in other embodiments of the invention, the filter cartridge nestles deeper inside the substantially conical shaped body 106.

In embodiments of the invention, a user may slide the disposable, high-airflow filter cartridge into the large diameter end of the universal filtering mouthpiece for smoking devices. In alternative embodiments, apertures in the sidewall of the substantially conical shaped body may exist for filter cartridges to be inserted and removed from the sides. In the preferred embodiment of the invention, the small diameter end 104 of the flexible and substantially conical shaped body includes a plurality of threads surrounding said small diameter end. The threads are capable of forming a seal when inserted into the inner diameter of the large diameter end of a pipe or other smoking device. The threads may also serve as ribbing for added strength as well as provide a user a better gripping surface. In embodiments of the invention, the number of threads and the width and height may vary. For example, an embodiment of the invention may include threads or protrusions which extend from the small diameter end 104 all the way to the large diameter end 102. In other embodiments of the invention, the threads or protrusions may only extend only a percentage of the length of the substantially conical shaped body 106. In other embodiments of the invention, the small diameter end of the substantially conical shaped body may assume different shapes and conformations to allow for custom fitting for specific smoking devices.

In embodiments of the invention, universal filtering mouthpiece for smoking devices includes a lanyard connection 110 located on the large diameter end of the flexible and substantially conical shaped body. A user may attach a lanyard to the universal filtering mouthpiece through the lanyard connection 110 and wear it around his or her neck for convenience and ease of access.

Figure 2A:
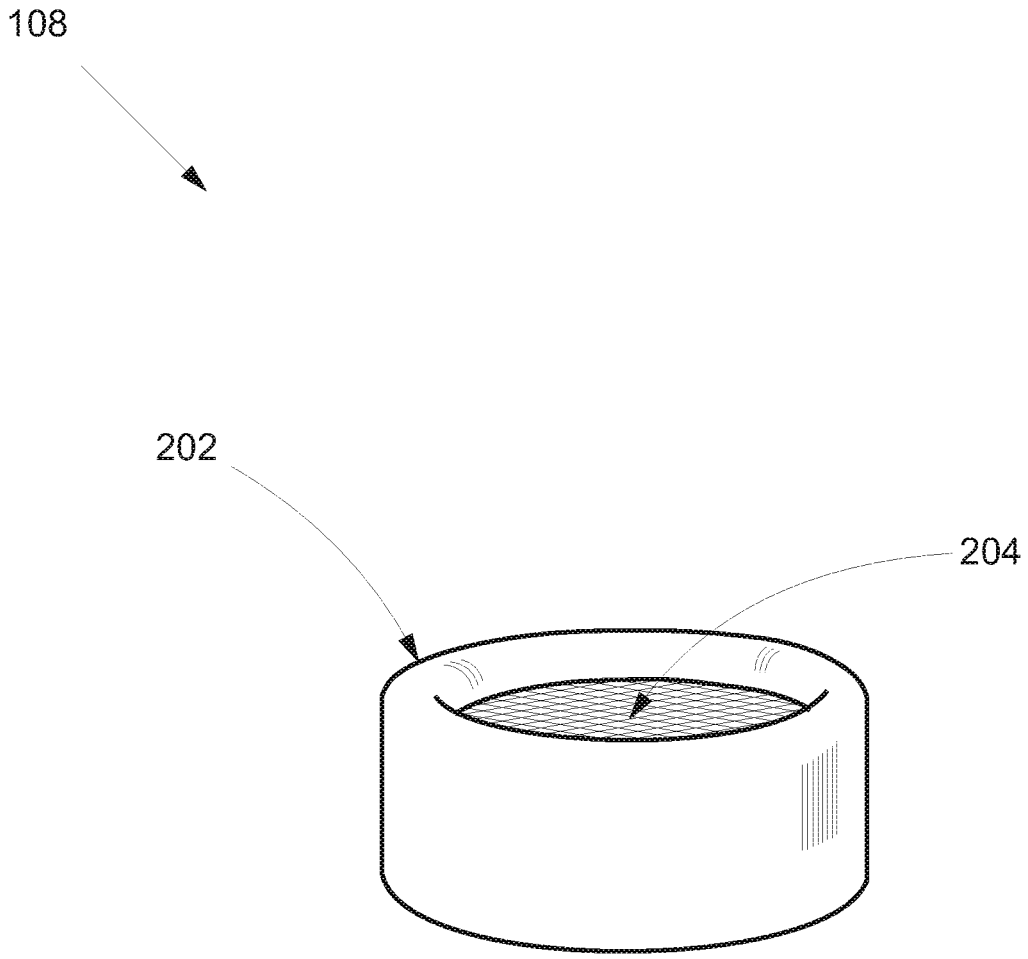
FIG. 2A is a perspective view of a disposable filter cartridge of a universal filtering mouthpiece for smoking devices in accordance with an embodiment of the invention.

FIG. 2A is a perspective view of a disposable filter cartridge 108 of a universal filtering mouthpiece for smoking devices in accordance with an embodiment of the invention. In an embodiment of the invention, the disposable, high-airflow filter cartridge consists of a rigid cylindrical frame 202. The rigid cylindrical frame 202 has rounded edges and houses a smoke filter 204 inside the inner diameter of rigid cylindrical frame. In the preferred embodiment of the invention, the smoke filter 204 includes at least one activated carbon filter element. The activated carbon filter unit provides a high surface area for capturing tars and impurities while remaining chemically inert. The object of the disposable filter cartridge is to allow passage of a majority of total volatilized active compounds while adsorbing larger, more harmful particulate matter. In alternative embodiments of the invention, the smoke filter may simply include a nonwoven material without the activated carbon. In other alternative embodiments of the invention, the filter cartridge may not necessarily be cylindrical in shape. Filter cartridges could be polyhedral in shape.

Figure 2B:
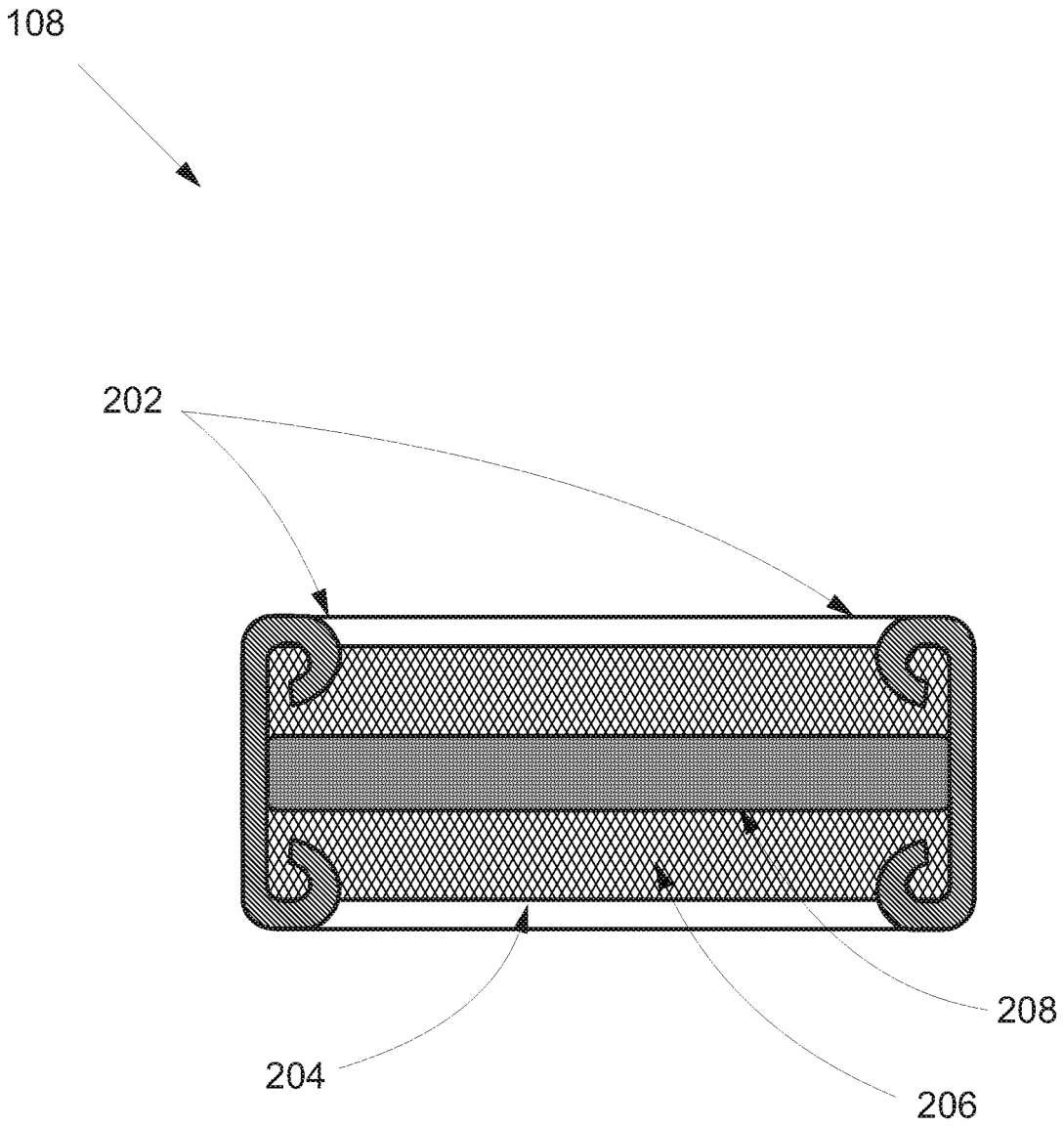
FIG. 2B is a cross sectional view of a disposable filter cartridge of a universal filtering mouthpiece for smoking devices in accordance with an embodiment of the invention.

FIG. 2B is a cross sectional view of a disposable filter cartridge of a universal filtering mouthpiece for smoking devices in accordance with an embodiment of the invention. In the preferred embodiment of the invention, the smoke filter includes at least one activated carbon filter element 208 which may be a layer of a non-woven sandwich activated carbon filter cloth. Persons having skill in the art will readily appreciate that such activated carbon filter cloth is a three-layer cloth which the top and bottom layers 206 are non-woven fabric cloth and the middle layer 208 consists of activated carbon powders. The non-woven fabric cloth may consist of, but is not limited to, synthetic polymers or cotton. In an embodiment of the invention, the non-woven fabric cloth and activated carbon powders are fastened by high temperature thermal pressing to form a single, contiguous filtering unit. In the preferred embodiment of the invention, the nonwoven fabric cloths are made from biodegradable and recycled materials. Persons having skill in the art will readily appreciate that other suitable activated carbon filter cloths may be employed such as, but not limited to, spun polypropylene or other spun polymers. Persons having skill in the art will further appreciate that the disposable filter cartridge may employ other types of filtering materials such as, but not limited to, cotton, linen, or other high surface area and high adsorption materials. Furthermore, activated carbon cloth may consist of varying layers of filter cloth and activated carbon depending on user need. In embodiments of the invention, the filter material is engineered not to chemically react with chemical compounds passing through the filter. The filter cartridge is designed to act as a physical filter for removing particulate matter, such as smoke and other solid particles. The activated carbon element serves to remove tars, resins and other solid or semi-solid contaminants as well as other harmful volatile compounds. The filter cartridge may also serve to remove certain bacteria, fungi and other pathogens which may survive in smoke or water in a bong.

In embodiments of the invention, the disposable, high-airflow filter cartridges are made from recycled, biodegradable materials. In the preferred embodiment of the invention, the rigid cylindrical frame 202 has rounded edges, and is made from a biodegradable paper or cardboard known and appreciated in the art. In the preferred embodiment, the edges of the rigid cylindrical frame are rolled over the smoke filter 204 so as to hold the smoke filter in place and to create a single disposable filter cartridge unit without the use of adhesives or glues. Alternative embodiments may include the use of adhesives or other means to create a single filter cartridge. Persons skilled in the art will appreciate that such filter cartridges can assume numerous dimensions and configurations. Also, in the preferred embodiment of the invention, the smoke filter 204 inside the inner diameter of rigid cylindrical frame is made from a biodegradable nonwoven material and activated carbon mixture known and appreciated in the art. In this view, the edges of the cylindrical frame are essentially rolled over and attached to the filter element to create the cylindrical frame's rounded edges. Persons having skill in the art will readily appreciate that numerous techniques and methods may be used to manufacture the disposable, high-airflow filter cartridges.

Figure 3:
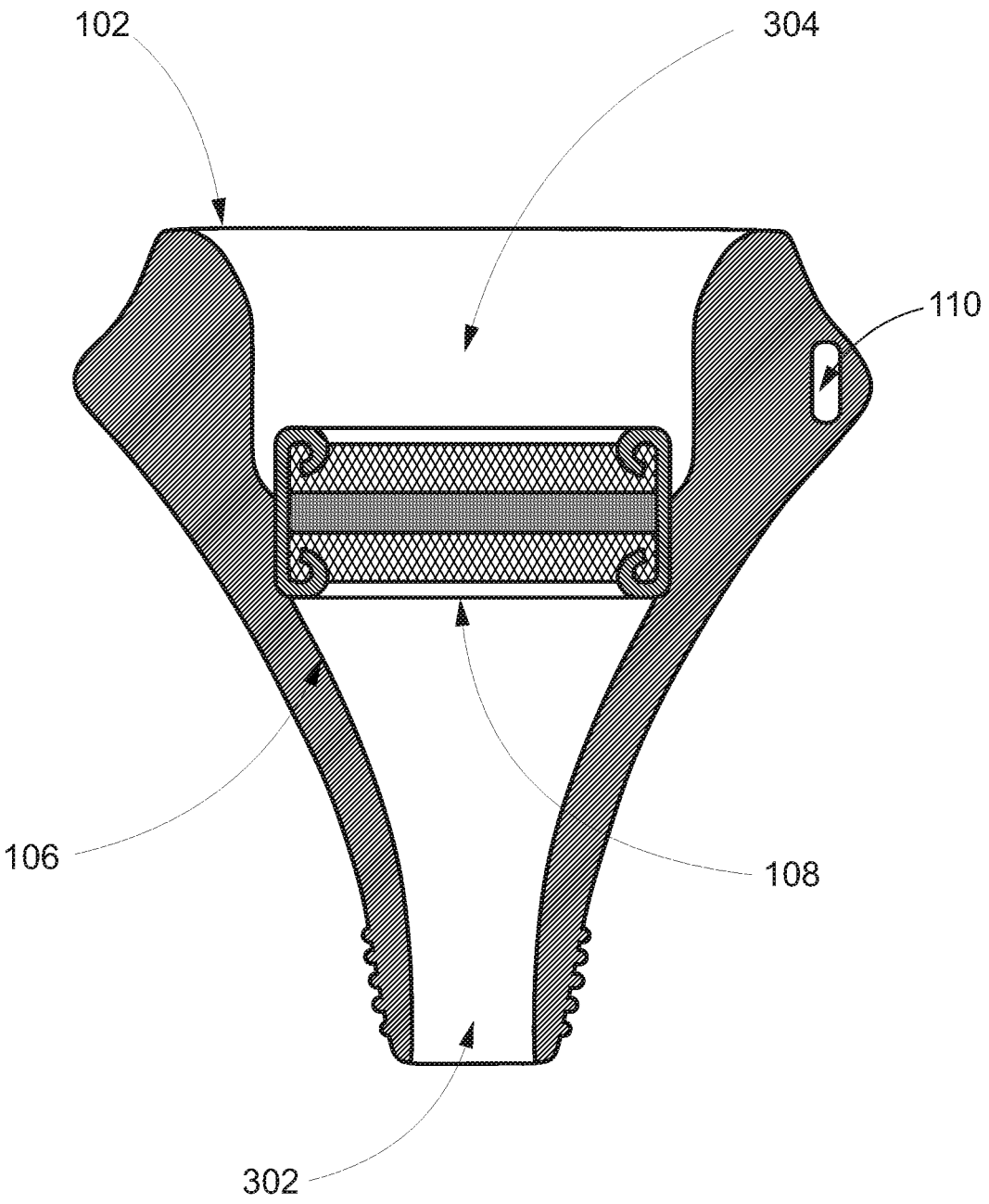
FIG. 3 is a cross sectional view of a universal filtering mouthpiece for smoking devices in accordance with an embodiment of the invention.

FIG. 3 is a cross sectional view of a universal filtering mouthpiece for smoking devices in accordance with an embodiment of the invention. A hollow smoke passage 302 runs axially through the center of conical shaped body 106 from the small diameter end to the large diameter end 102. A user can use the large diameter end as a mouthpiece by simply inserting her or his lips into the hollow end. The large diameter end 102 may taper in differing configurations so as to provide a user the opportunity to create a better mouth seal around the large diameter end when using the universal filtering mouthpiece for smoking devices. Alternatively, a user may use the narrow diameter end as a mouthpiece with the large diameter end stretched over a smoking device with a large diameter. A filter cartridge housing 304 is centered axially at the large diameter end of the said flexible and substantially conical shaped body which communicates with the hollow smoke passage and capable of housing a removable filter. In embodiments of the invention, the filter cartridge housing 304 may assume a shape which allows for easy insertion and removal of a high-airflow filter cartridge 108. The filter cartridge nestles inside the flexible and substantially conical shaped body so as to create an airtight seal while not interfering with smoking.

In the preferred embodiment of the invention, the material used to make flexible and substantially conical shaped body is platinum-cured silicone which has a high degree of elasticity. Moreover, platinum-cured silicone is known for its bacteriostatic and antimicrobial qualities. The flexible and substantially conical shaped body may be fabricated through numerous means in the art such as, but not limited to, casting, injection molding, milling, and 3D printing. Because of the body's high degree of elasticity, a disposable, high-airflow filter cartridge 108 may be easily inserted and removed from the filter cartridge filter housing 304 while being able to seat inside the filter cartridge housing 108 without creating any air leaks. The universal filtering mouthpiece for smoking devices includes a lanyard connection 110 located on the large diameter end of the flexible and substantially conical shaped body.

Figure 4:
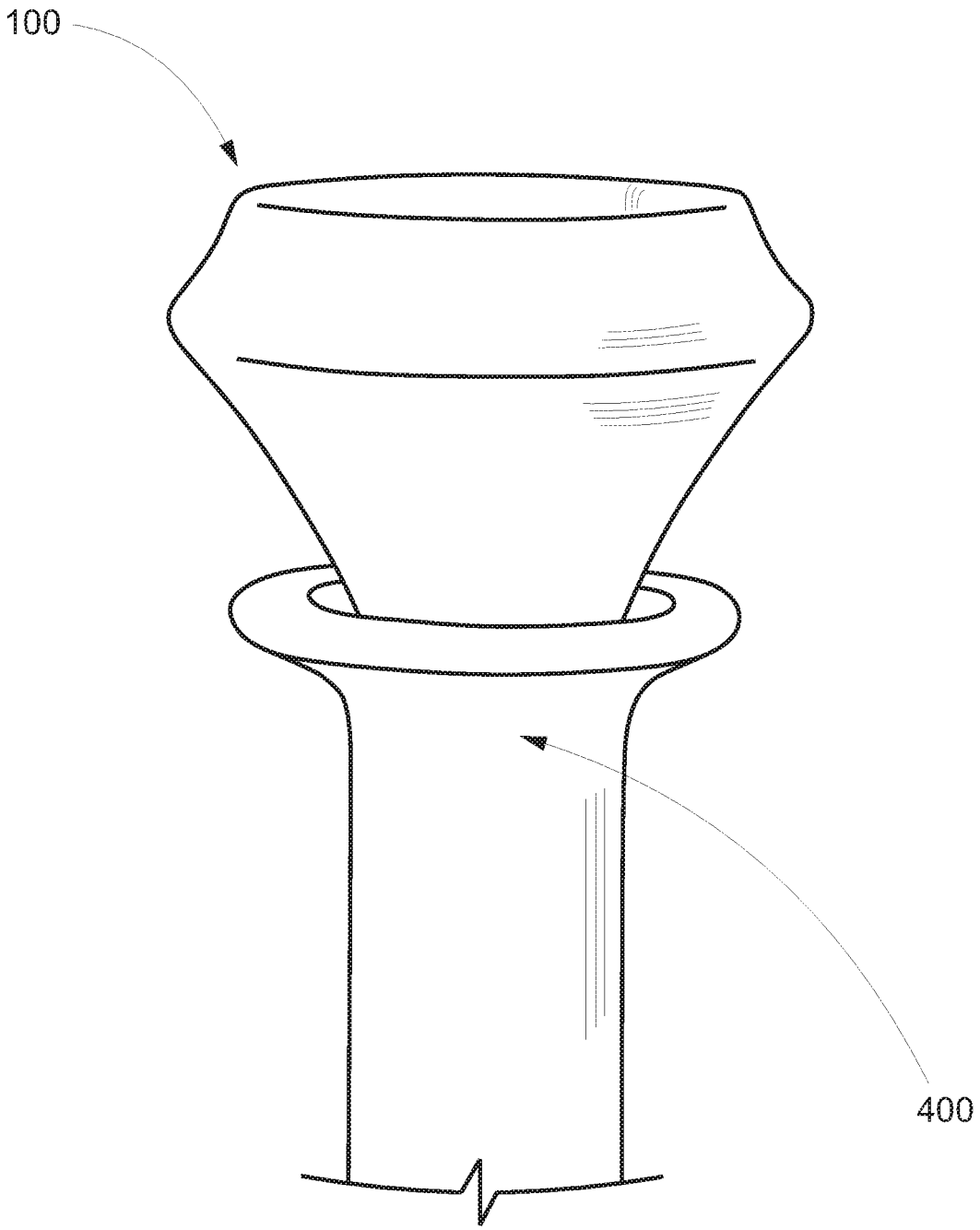
FIG. 4 is a perspective view of a universal filtering mouthpiece for smoking devices housed inside a wide diameter mouthpiece of a smoking device.

FIG. 4 is a perspective view of a universal filtering mouthpiece for smoking devices 100 housed inside a wide diameter mouthpiece 400 of a smoking device. Non-limiting examples of a wide diameter mouthpiece of a smoking device include mouthpieces found on bongs and pipes. In this view, the flexible and substantially conical shaped body is configured to sealably fit into mouthpieces of smoking devices having relatively large inner diameters, such as a standard bong, so as to form an air-tight seal. In the preferred embodiment of the invention, the material used to make flexible and substantially conical shaped body is platinum-cured silicone which has a high degree of elasticity. In alternative embodiments of the invention, the material used may be a rubber or other elastomer. Such materials provide for a high degree of conformability to wide diameter smoking devices, thus making use of the universal filtering mouthpiece for smoking devices easy and effective. Multiple users may use their own personal mouthpieces on a shared smoking apparatus in order to minimize the spread of pathogens.

Figure 5:
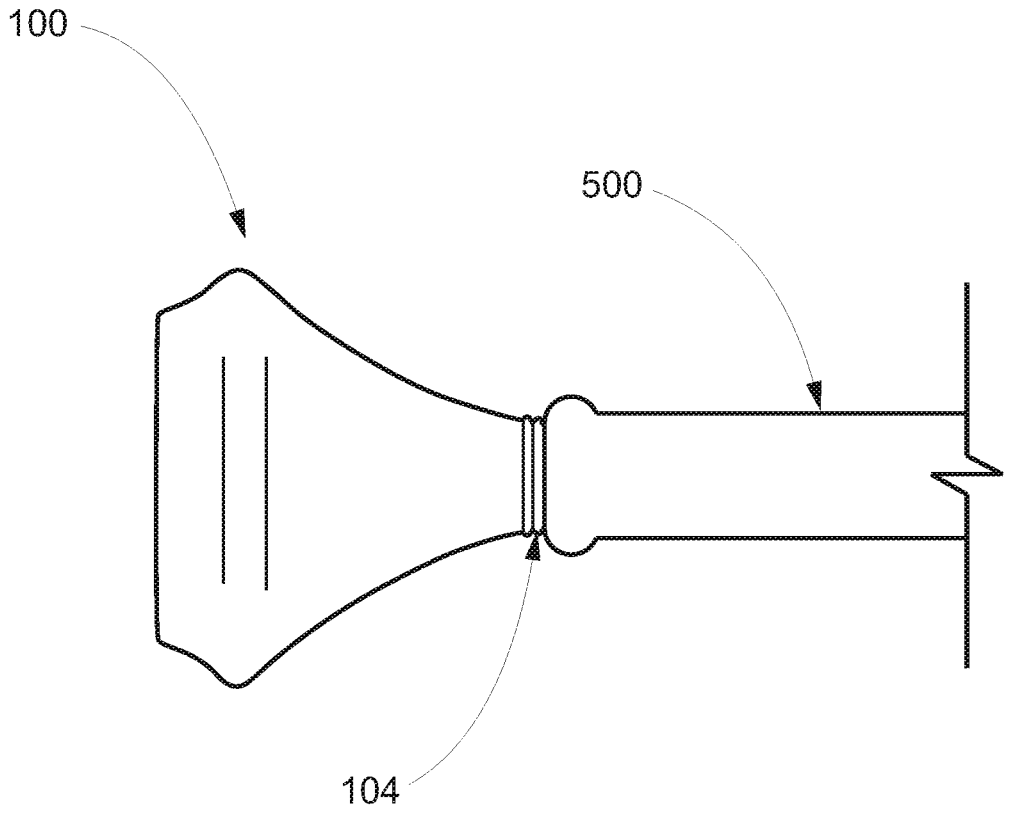
FIG. 5 is a side view of a universal filtering mouthpiece for smoking devices housed inside a narrow diameter mouthpiece of a smoking device.

FIG. 5 is a side view of a universal filtering mouthpiece for smoking devices 100 housed inside a narrow diameter mouthpiece 500 of a smoking device. Non-limiting examples of narrow diameter mouthpieces include mouthpieces found on pipes, electronic cigarettes, and hookah mouthpieces. In this view, the small diameter end of the flexible and substantially conical shaped body includes a plurality of threads surrounding said small diameter end, said threads being capable of forming an air-tight seal when inserted into the inner diameter of the large diameter end of a pipe or other smoking device. The large diameter end of the substantially conical shaped body is used as a mouthpiece. In the preferred embodiment of the invention, the material used to make flexible and substantially conical shaped body is platinum-cured silicone which has a high degree of elasticity. In alternative embodiments of the invention, the material used may be a rubber or other elastomer. Such materials provide for a high degree of conformability to narrow diameter smoking devices, thus making use of the universal filtering mouthpiece for smoking devices easy and effective. Multiple users may use their own personal mouthpieces in order to minimize the spread of pathogens.

Figure 6:
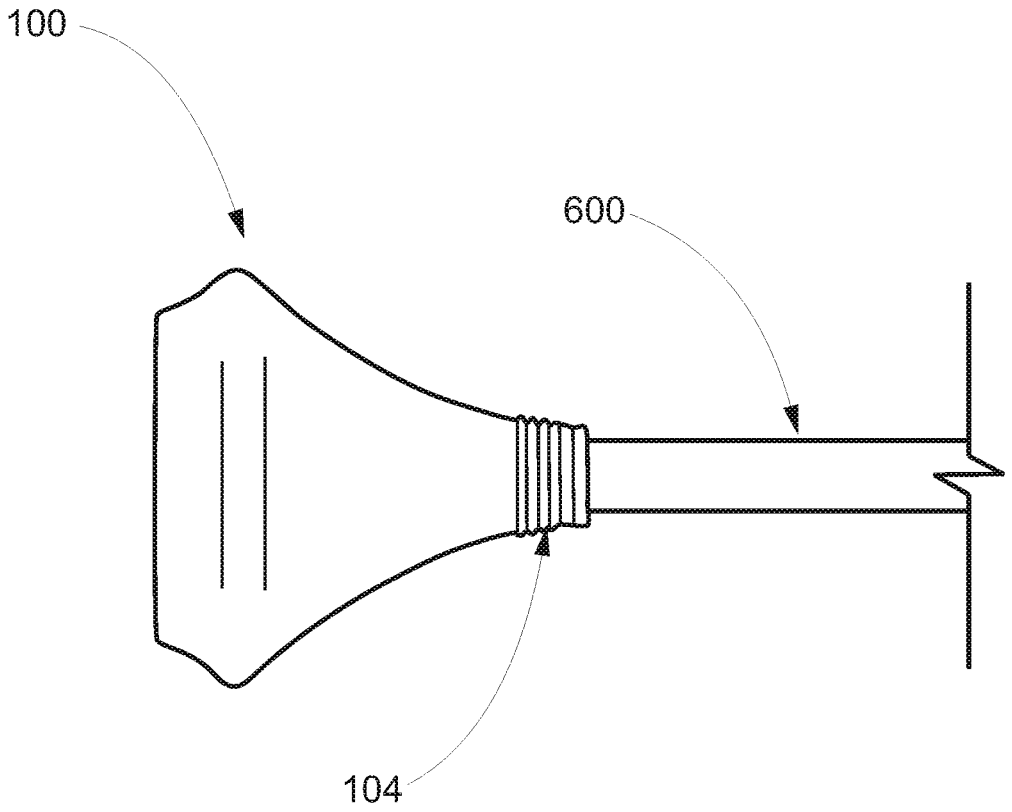
FIG. 6 is a side view of a universal filtering mouthpiece for smoking devices with the small diameter end stretched over the end of a smoking device.

FIG. 6 is a side view of a universal filtering mouthpiece for smoking devices 100 with the small diameter end 104 stretched over the end of a narrow diameter smoking device 600. Non-limiting examples of narrow diameter mouthpieces include the ends of pipes, hookah mouthpieces, cigarettes and pre-roll cigarettes. In this view, the small diameter end of the flexible and substantially conical shaped body may be stretched over the end of a smoking device because of the stretchable nature of the material used to create the flexible and substantially conical shaped body. The large diameter end of the substantially conical shaped body is used as a mouthpiece. When stretched over the end of a smoking device, an air-tight seal is created. Because of the elastic nature of the mouthpiece, the small diameter end may fit over devices of various shapes. Non-limiting examples of various shapes may include elliptical, round, square, rectangular, and other polygonal configurations. In the preferred embodiment of the invention, the material used to make flexible and substantially conical shaped body is platinum-cured silicone which has a high degree of elasticity. In alternative embodiments of the invention, the material used may be a rubber or other elastomer. Such materials provide for a high degree of elasticity to stretch over the ends of multiple types of smoking devices. Multiple users may use their own personal mouthpieces in order to minimize the spread of pathogens.

Figure 7:
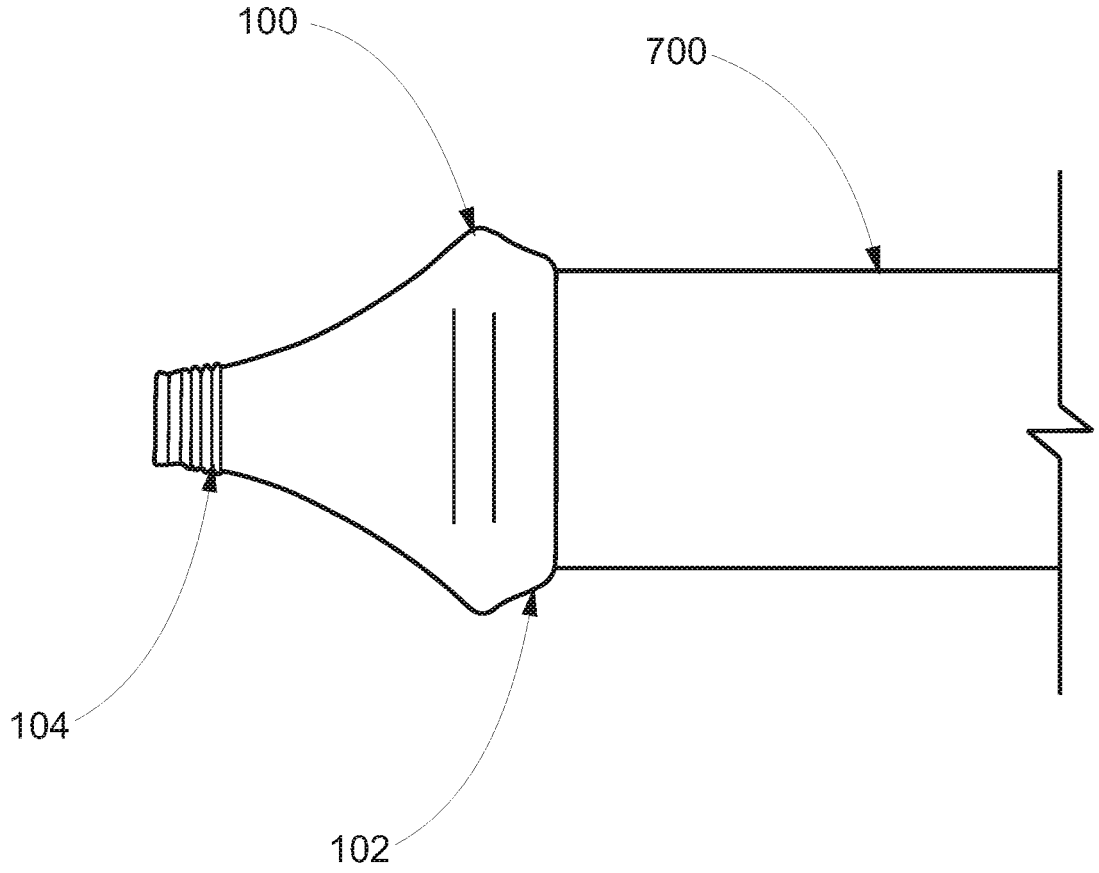
FIG. 7 is a side view of a universal filtering mouthpiece for smoking devices with the large diameter end stretched over the end of a smoking device.

FIG. 7 is a side view of a universal filtering mouthpiece for smoking devices 100 with the large diameter end 102 stretched over the end of a large diameter smoking device 700. Non-limiting examples of large diameter mouthpieces include the ends of bongs, and hookahs. In this view, the large diameter end of the flexible and substantially conical shaped body may be stretched over the end of a smoking device because of the stretchable nature of the material used to create the flexible and substantially conical shaped body. The small diameter end 104 of the substantially conical shaped body is used as a mouthpiece. When stretched over the end of a smoking device, an air-tight seal is created. Because of the elastic nature of the mouthpiece, the large diameter end may fit over devices of various shapes. Non-limiting examples of various shapes may include elliptical, round, square, rectangular, and other polygonal configurations. In the preferred embodiment of the invention, the material used to make flexible and substantially conical shaped body is platinum-cured silicone which has a high degree of elasticity. In alternative embodiments of the invention, the material used may be a rubber or other elastomer. Such materials provide for a high degree of elasticity to stretch over the ends of multiple types of smoking devices. Multiple users may use their own personal mouthpieces in order to minimize the spread of pathogens.

The universal filtering mouthpiece may be implemented as a method for one or more users of one or more smoking devices to filter smoke and prevent the transmission of, and infection from, infectious pathogens using individual universal mouthpieces for smoking devices. Use of the universal filtering mouthpiece for smoking devices involves each user cleaning and sanitizing an individual universal mouthpiece for smoking devices; each user inserting a disposable, high-airflow filter cartridge into the filter housing of each individual universal mouthpiece for smoking devices; each user attaching the small diameter end of the universal mouthpiece for smoking devices to a smoking device so as to create an airtight seal; each user smoking from the one or more smoking devices; and each user removing their universal mouthpiece for smoking devices from the smoking device.

All the features disclosed in this specification, including any accompanying abstract and drawings, may be replaced by alternative features serving the same, equivalent or similar purpose, unless expressly stated otherwise. Thus, unless expressly stated otherwise, each feature disclosed is one example only of a generic series of equivalent or similar features.

Having fully described at least one embodiment of the universal filtering mouthpiece for smoking devices, other equivalent or alternative methods of implementing the universal filtering mouthpiece for smoking devices according to the present invention will be apparent to those skilled in the art. Various aspects of the invention have been described above by way of illustration, and the specific embodiments disclosed are not intended to limit the invention to the particular forms disclosed. The particular implementation of the universal filtering mouthpiece for smoking devices may vary depending upon the particular context or application. By way of example, and not limitation, the universal filtering mouthpiece for smoking devices described in the foregoing was principally directed to a standard size mouthpiece. However, similar techniques may instead be applied to other mouthpieces such as larger or smaller variants or wider or narrower variants which implementations of the present invention are contemplated as within the scope of the present invention. Alternative embodiments may also include different shaped ends of the substantially conical shaped body along with openings which provide a user greater access to the filter cartridges. Other uses of the invention may be applied to public institutions such as hookah lounges where future regulatory compliance may be implemented. The invention is thus to cover all modifications, equivalents, and alternatives falling within the spirit and scope of the following claims. It is to be further understood that not all of the disclosed embodiments in the foregoing specification will necessarily satisfy or achieve each of the objects, advantages, or improvements described in the foregoing specification.

Although specific features of the universal filtering mouthpiece for smoking devices are shown in some drawings and not others, persons skilled in the art will understand that this is for convenience. Each feature may be combined with any or all of the other features in accordance with the invention. The words "including," "comprising," "having," and "with" as used herein are to be interpreted broadly and comprehensively, and are not limited to any physical interconnection. Claim elements and steps herein may have been numbered and/or lettered solely as an aid in readability and understanding. Any such numbering and lettering in itself is not intended to and should not be taken to indicate the ordering of elements and/or steps in the claims to be added at a later date.

Any amendment presented during the prosecution of the application for this patent is not a disclaimer of any claim element presented in the description or claims to be filed. Persons skilled in the art cannot reasonably be expected to draft a claim that would literally encompass each and every equivalent.

What is claimed is:

1. A universal filtering mouthpiece for smoking devices comprising:

a. a flexible and substantially conical shaped body having a small diameter end and a large diameter end, wherein the small diameter end of the flexible and substantially conical shaped body includes a plurality of threads surrounding said small diameter end, said threads being capable of forming a seal when inserted into the inner diameter of a pipe or other smoking device;

b. a hollow smoke passage which runs axially through the said flexible and substantially conical shaped body from the small diameter end to the large diameter end;

c. a filter cartridge housing centered axially at the large diameter end of the said flexible and substantially conical shaped body which communicates with the hollow smoke passage and is capable of housing a removable filter; and d. a disposable, high-airflow filter cartridge consisting of a rigid cylindrical frame having rounded edges, said edges of the said rigid cylindrical frame folded over and attached to a smoke filter consisting of activated carbon cloth housed inside the inner diameter of the said rigid cylindrical frame; said filter cartridge inserted from the large diameter end and nestles inside the said filter cartridge housing centered axially at the large diameter end of the said flexible and substantially conical shaped body having a small diameter end and a large diameter end.

2. The universal filtering mouthpiece for smoking devices of claim 1 wherein the disposable, high-airflow filter cartridge consisting of a rigid cylindrical frame having rounded edges, said rigid cylindrical frame housing a smoke filter inside the inner diameter of said rigid cylindrical frame slidingly fits into the filter housing from the large diameter end of the universal filtering mouthpiece, is held inside the filter housing by friction, and forms an airtight seal, and may be removed by manipulating the flexible and substantially conical shaped body or by prying with a mechanical device.

3. The universal filtering mouthpiece for smoking devices of claim 1 wherein the disposable, high-airflow filter cartridge consisting of a rigid cylindrical frame having rounded edges, said rigid cylindrical frame housing a smoke filter inside the inner diameter of said rigid cylindrical frame is made from biodegradable materials.

4. The universal filtering mouthpiece for smoking devices of claim 1 further comprising a lanyard connection located on the large diameter end of the flexible and substantially conical shaped body.

5. The universal filtering mouthpiece for smoking devices of claim 1 wherein the material of the flexible and substantially conical shaped body is molded platinum cured silicone.

6. The universal filtering mouthpiece for smoking devices of claim 1 wherein the flexible and substantially conical shaped body is configured to fit into mouthpieces of smoking devices having relatively large inner diameters so as to form an air-tight seal.

7. The universal filtering mouthpiece for smoking devices of claim 1 wherein the small diameter end of the flexible and substantially conical shaped body is capable of stretching over the ends of smoking devices with relatively narrower outer diameters so as to form an air-tight seal.

8. A universal filtering mouthpiece kit for smoking devices comprising:

a. a flexible and substantially conical shaped body having a small diameter end and a large diameter end, said flexible and substantially conical shaped body having a hollow smoke passage which runs axially from the small diameter end to the large diameter end and a filter housing centered axially at the large diameter end which communicates with the hollow smoke passage and is capable of housing a disposable removable filter inserted from the large diameter end;

b. a disposable, high-airflow filter cartridge package containing one or more disposable high-airflow filter cartridges, each disposable, high-airflow filter cartridge consisting of a rigid cylindrical frame having rounded edges, with the ends of the said cylindrical frame folded over and attached to a smoke filter consisting of activated carbon cloth, housing the said smoke filter inside the inner diameter of said rigid cylindrical frame, said high-airflow cartridge capable of being inserted from the large diameter end and nestle inside the filter housing of the said flexible and substantially conical shaped body having a small diameter end and a large diameter end without creating any air leaks; and c. a lanyard.

9. The universal filtering mouthpiece kit for smoking devices of claim 8 wherein the disposable, high-airflow filter cartridge consisting of a rigid cylindrical frame having rounded edges, said rigid cylindrical frame housing a smoke filter inside the inner diameter of said rigid cylindrical frame slidingly fits into the filter housing from the large diameter end of the universal filtering mouthpiece, is held inside the filter housing by friction, and forms an airtight seal, and may be removed by manipulating the flexible and substantially conical shaped body or by prying with a mechanical device.

10. The universal filtering mouthpiece kit for smoking devices of claim 8 wherein the disposable, high-airflow filter cartridge consisting of a rigid cylindrical frame having rounded, said rigid cylindrical frame housing a smoke filter inside the inner diameter of said rigid cylindrical frame is made from biodegradable materials.

11. The universal filtering mouthpiece kit for smoking devices of claim 8 further comprising a lanyard connection located on the large diameter end of the flexible and substantially conical shaped body.

12. The universal filtering mouthpiece kit for smoking devices of claim 8 wherein the material of the flexible and substantially conical shaped body is molded platinum cured silicone.

13. The universal filtering mouthpiece kit for smoking devices of claim 8 wherein the small diameter end of the flexible and substantially conical shaped body includes a plurality of threads surrounding said small diameter end, said threads being capable of forming a seal when inserted into a pipe or other smoking device.

14. The universal filtering mouthpiece kit for smoking devices of claim 8 wherein the flexible and substantially conical shaped body is configured to fit into mouthpieces of smoking devices having large diameters.

15. The universal filtering mouthpiece kit for smoking devices of claim 8 wherein the small diameter end of the flexible and substantially conical shaped body may stretch over a smoking device such as a pipe, hookah mouthpiece, or the filter end of a pre-rolled cigarette so as to form an air-tight seal.

* * * * *